US006487379B2

(12) United States Patent
Sato

(10) Patent No.: US 6,487,379 B2
(45) Date of Patent: Nov. 26, 2002

(54) CONTROL SYSTEM FOR PAPER FEEDING APPARATUS AND/OR PAPER DISCHARGING APPARATUS

(75) Inventor: Kaoru Sato, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/934,609

(22) Filed: Aug. 23, 2001

(65) Prior Publication Data

US 2002/0025175 A1 Feb. 28, 2002

(30) Foreign Application Priority Data

Aug. 29, 2000 (JP) ..... 2000-259812

(51) Int. Cl.[7] ..... G03G 15/00; B65H 5/26; B65H 29/00

(52) U.S. Cl. ..... 399/16; 271/9.01; 271/279; 399/23; 399/405

(58) Field of Search ..... 399/16, 23, 405, 399/38, 361; 271/9.01, 9.02, 279

(56) References Cited

U.S. PATENT DOCUMENTS

| | | | | |
|---|---|---|---|---|
| 4,970,544 A | * | 11/1990 | Furusawa et al. | 399/361 X |
| 4,998,216 A | | 3/1991 | Hino et al. | 364/519 |
| 5,126,786 A | | 6/1992 | Tanaka | 355/46 |
| 5,154,411 A | | 10/1992 | Saito et al. | 271/289 |
| 5,164,769 A | * | 11/1992 | Hashimoto et al. | 399/361 X |
| 5,168,316 A | * | 12/1992 | Hino et al. | 399/23 |
| 5,450,170 A | | 9/1995 | Kimizuka et al. | 355/218 |
| 5,481,336 A | | 1/1996 | Tachibana et al. | 355/207 |
| 5,713,060 A | | 1/1998 | Sato et al. | 399/20 |
| 5,946,541 A | * | 8/1999 | Kakigi | 399/405 |
| 5,963,755 A | * | 10/1999 | Ueda et al. | 399/23 |
| 6,169,567 B1 | * | 1/2001 | Hashimoto et al. | 399/38 |
| 6,204,872 B1 | * | 3/2001 | Hashimoto et al. | 399/405 X |
| 6,359,696 B1 | * | 3/2002 | Hori et al. | 399/16 X |

FOREIGN PATENT DOCUMENTS

| | | |
|---|---|---|
| EP | 0 849 915 | 6/1998 |
| GB | 2 313 529 | 11/1997 |

* cited by examiner

*Primary Examiner*—Fred L Braun
(74) *Attorney, Agent, or Firm*—Fitzpatrick, Cella, Harper & Scinto

(57) ABSTRACT

In a system wherein a plurality of paper feeding devices can be serially connected to a recording device body, where the recording device body is regarded as an electrically upstreammost device, an electrically downstreammost paper feeding device controls only itself, a paper feeding device upstream of the downstreammost paper feeding device controls itself and the paper feeding device downstream thereof, and a paper feeding device further upstream controls itself and the paper feeding device immediately downstream thereof. The recording device body controls only the closest downstream paper feeding device even if the paper feeding devices connected are increased to any number. For every paper feeding device, where a plurality of paper feeding devices are connected downstream thereof, the device controls only itself and the closest downstream paper feeding device.

27 Claims, 13 Drawing Sheets

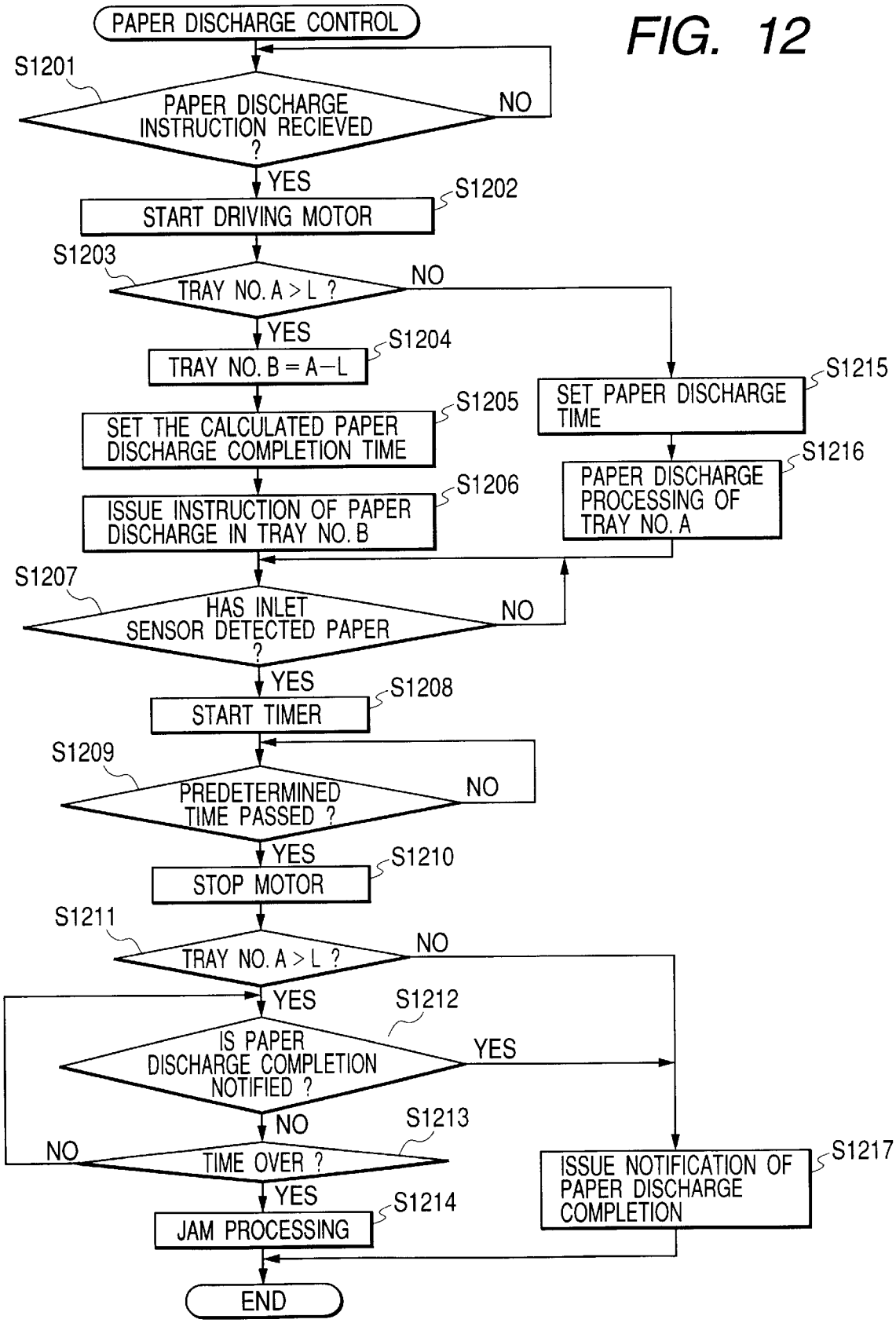
FIG. 12
PAPER DISCHARGE CONTROL
S1201
PAPER DISCHARGE INSTRUCTION RECIEVED ?
NO
YES
S1202
START DRIVING MOTOR
S1203
TRAY NO. A > L ?
NO
YES
S1204
TRAY NO. B = A−L
S1205
SET THE CALCULATED PAPER DISCHARGE COMPLETION TIME
S1206
ISSUE INSTRUCTION OF PAPER DISCHARGE IN TRAY NO. B
S1215
SET PAPER DISCHARGE TIME
S1216
PAPER DISCHARGE PROCESSING OF TRAY NO. A
S1207
HAS INLET SENSOR DETECTED PAPER ?
NO
YES
S1208
START TIMER
S1209
PREDETERMINED TIME PASSED ?
NO
YES
S1210
STOP MOTOR
S1211
TRAY NO. A > L ?
NO
YES
S1212
IS PAPER DISCHARGE COMPLETION NOTIFIED ?
YES
NO
S1213
TIME OVER ?
NO
YES
S1214
JAM PROCESSING
S1217
ISSUE NOTIFICATION OF PAPER DISCHARGE COMPLETION
END

CONTROL SYSTEM FOR PAPER FEEDING APPARATUS AND/OR PAPER DISCHARGING APPARATUS

BACKGROUND OF THE INVENTION

1. Field of the Invention

The present invention relates to paper feeding apparatus and paper discharging apparatus and, more particularly, to control of paper feeding apparatus and paper discharging apparatus connected to recording apparatus.

2. Related Background Art

In a print system such as a recording system, a copying machine, or the like, where a plurality of paper feeding devices or paper discharging devices were connected to the main body of a recording device, the main body of the recording device communicated with each of the paper feeding devices or paper discharging devices through communication means constructed in the multidrop system or the daisy chain system, to control each of the paper feeding devices or paper discharging devices.

As a result, the main body of the recording device had to perform more complicated control with increase in the number of paper feeding devices or paper discharging devices connected, which resulted in lengthening development periods of control firmware and degrading reliability of the system.

In order to clarify electrical interfaces and physical device locations, a specific ID needed to be assigned to each paper feeding device or paper discharging device and this process was entrusted to an operator. In addition, the operator was also entrusted with a process of uniquely fixing a connection order of the electrical interfaces of the paper feeding devices or paper discharging devices. These processes bothered the operator and there were possibilities that the operator set an incorrect ID or connected interface cables in an incorrect connection order. These errors could pose the problem of causing such trouble that the main body of the recording device failed to adequately control the paper feeding devices or paper discharging devices in the system.

SUMMARY OF THE INVENTION

An object of the present invention is to provide paper feeding apparatus and paper discharging apparatus in print systems such as recording apparatus, copying machines, etc. while solving the above problem.

In order to accomplish the above object, a paper feeding apparatus according to the present invention is a paper feeding apparatus used in electrical cascade connection of plural paper feeding devices with an external device, and comprising a first communication means for communication between an electrically downstream paper feeding device and the apparatus itself and a second communication means for communication between an electrically upstream paper feeding device and the apparatus itself, said apparatus comprising:

- a means for acquiring device information of said downstream device through said first communication means;
- a first control means for controlling the upstream device by converting said acquired device information concerning the downstream device and device information of the apparatus itself together into device information as a single device, and transmitting to said upstream device by means of said second communication means; and
- a means for analyzing control information from said upstream device and transmitting control information through the apparatus itself to said downstream device, which is second control means for controlling the apparatus itself, based on information concerning the apparatus itself out of said control information, and transmitting information concerning said downstream device through said first communication means to said downstream device according to said control information.

Preferably, said second control means comprises separating means for separating said information concerning said downstream device from said control information.

Preferably, the apparatus further comprises means for automatically effecting electrical connection with the upstream device and downstream device when physically connected to said upstream device and downstream device, and a sheet conveyance path from said upstream device to said downstream device is uniquely determined by said physical connection.

Preferably, the apparatus comprises a means for effecting physical connection with said upstream device and downstream device and a means for effecting electrical connection with said upstream device and downstream device independently of each other, and each paper feeding device comprises an independent sheet conveyance path to said external device.

Preferably, said device information of said downstream device includes at least the number of trays thereof and tray information concerning said trays, and said converted information to be transmitted to said upstream device includes at least the number of trays resulting from addition of the number of trays of the apparatus itself to said number of trays, and tray information concerning the trays of said downstream device and the apparatus itself.

Preferably, said tray information includes at least one of information about a loadable sheet size, information about a conveyance path, a capacity of loadable sheets, a current sheet load situation, and a type of sheets loaded at present.

Preferably, said tray information includes conveyance path information and said conveyance path information includes information to identify a continuous conveyance path or an independent conveyance path.

Preferably, said tray information includes a sheet delay jam detecting time; when the apparatus itself has a sheet conveyance path continuous to said downstream device, said first control means transmits to said upstream device a value resulting from addition of said sheet delay jam detecting time of the apparatus itself to said sheet delay jam detecting time transmitted from said downstream device; when the apparatus itself has no sheet conveyance path continuous to said downstream device, said first control means transmits to said upstream device said sheet delay jam detecting time transmitted from said downstream device.

Preferably, said control information from said upstream device includes tray position information of a tray as a controlled object; when said tray position information is judged as tray position information of said downstream device, said second control means converts said tray position information into tray position information resulting from subtraction of the number of trays of the apparatus itself from said tray position information and transmits the resultant tray position information to said downstream device.

Preferably, said external device is a recording device for recording an image on the sheet.

A paper discharging apparatus according to the present invention is a paper discharging apparatus used in electrical cascade connection of plural paper discharging devices with an external device, and comprising a first communication means for communication between an electrically downstream paper discharging device and the apparatus itself and a second communication means for communication between an electrically upstream paper discharging device and the apparatus itself, said apparatus comprising: a means for acquiring device information of said downstream device through said first communication means; a first control means for controlling the upstream device by converting said acquired device information concerning the downstream device and device information of the apparatus itself together into device information as a single device, to said upstream device through said second communication means to control the upstream device; and a means for analyzing control information from said upstream device and transmitting control information through the apparatus itself to said downstream device, which is second control means for controlling the apparatus itself, based on information concerning the apparatus itself out of said control information, and transmitting information concerning said downstream device through said first communication means to said downstream device according to said control information.

Preferably, said second control means comprises separating means for separating said information concerning said downstream device from said control information.

Preferably, the apparatus comprises a means for automatically effecting electrical connection with the upstream device and downstream device when physically connected to said upstream device and downstream device, and a sheet conveyance path from said upstream device to said downstream device is uniquely determined by said physical connection.

Preferably, the apparatus comprises a means for effecting physical connection with said upstream device and downstream device and means for effecting electrical connection with said upstream device and downstream device independently of each other, and each paper discharging device comprises an independent sheet conveyance path to said external device.

Preferably, said device information of said downstream device includes at least the number of trays thereof and tray information concerning said trays, and said converted information to be transmitted to said upstream device includes at least the number of trays resulting from addition of the number of trays of the apparatus itself to said number of trays, and tray information concerning the trays of said downstream device and the apparatus itself.

Preferably, said tray information includes conveyance path information and said conveyance path information includes information to identify a continuous conveyance path or an independent conveyance path.

Preferably, said tray information includes at least one of conveyance path information, a capacity of loadable sheets, and a current sheet load situation.

Preferably, said tray information includes a discharge completion time of a sheet; when the apparatus itself has a sheet conveyance path continuous to said downstream device, said first control means transmits to said upstream device a value resulting from addition of a discharge completion time of the apparatus itself to said discharge completion time transmitted from said downstream device; when said apparatus itself has no sheet conveyance path continuous to said downstream device, said first control means transmits to said upstream device said discharge completion time transmitted from said downstream device.

Preferably, said control information from said upstream device includes tray position information of a tray as a controlled object; when said tray position information is judged as tray position information of said downstream device, said second control means converts said tray position information into tray position information resulting from subtraction of the number of trays of the apparatus itself from said tray position information and transmits the resultant tray position information to said downstream device.

Preferably, said device information transmitted from said downstream device includes function information of said downstream device.

Preferably, said function information includes information about at least some of normal stacking, job offset, staple, punch, folding, saddle stitch, and gluing.

Preferably, the control information transmitted from said upstream device includes function designating information of a tray as a controlled object.

Preferably, said external device is a recording device for recording an image on the sheet.

In the present invention embracing the above configurations, the apparatus is provided with the communication means of two lines between the apparatus itself and the upstream device and between the apparatus itself and the downstream device; the apparatus transmits to the downstream paper feeding device the device information resulting from addition of the device information of the apparatus itself to the information of the upstream device sent, for example, from the upstream paper feeding device; the apparatus analyzes the control information sent from the downstream paper feeding device; if the control information is one concerning the apparatus itself, the apparatus controls itself, based on the control information; if the control information is information concerning an upstream paper feeding device, the apparatus separates the information and sends it to the upstream paper feeding device; whereby the external device such as the recording device body or the like can perform the control as if a single paper feeding device is connected thereto even with plural paper feeding devices connected.

According to the present invention, the information transmission with the upstream device and the downstream device is permitted through the communication means of two lines between the apparatus itself and the upstream device and between the apparatus itself and the downstream device, and the external device such as the recording device body or the like can control a plurality of devices as if it controls a single paper feeding device or a single paper discharging device, which can decrease the control load on the external device such as the recording device body or the like. Accordingly, the control firmware with high reliability can be created within a short period, without failure in appropriate control due to an error of the operator. Further, since there is no limit to the number of paper feeding devices or paper discharging devices connected, a print system with high expandability can be constructed.

BRIEF DESCRIPTION OF THE DRAWINGS

FIG. 12 is a flowchart showing control procedures for paper discharging control in Embodiment 3.

DETAILED DESCRIPTION OF THE PREFERRED EMBODIMENTS

Embodiment 1

Figure 1:
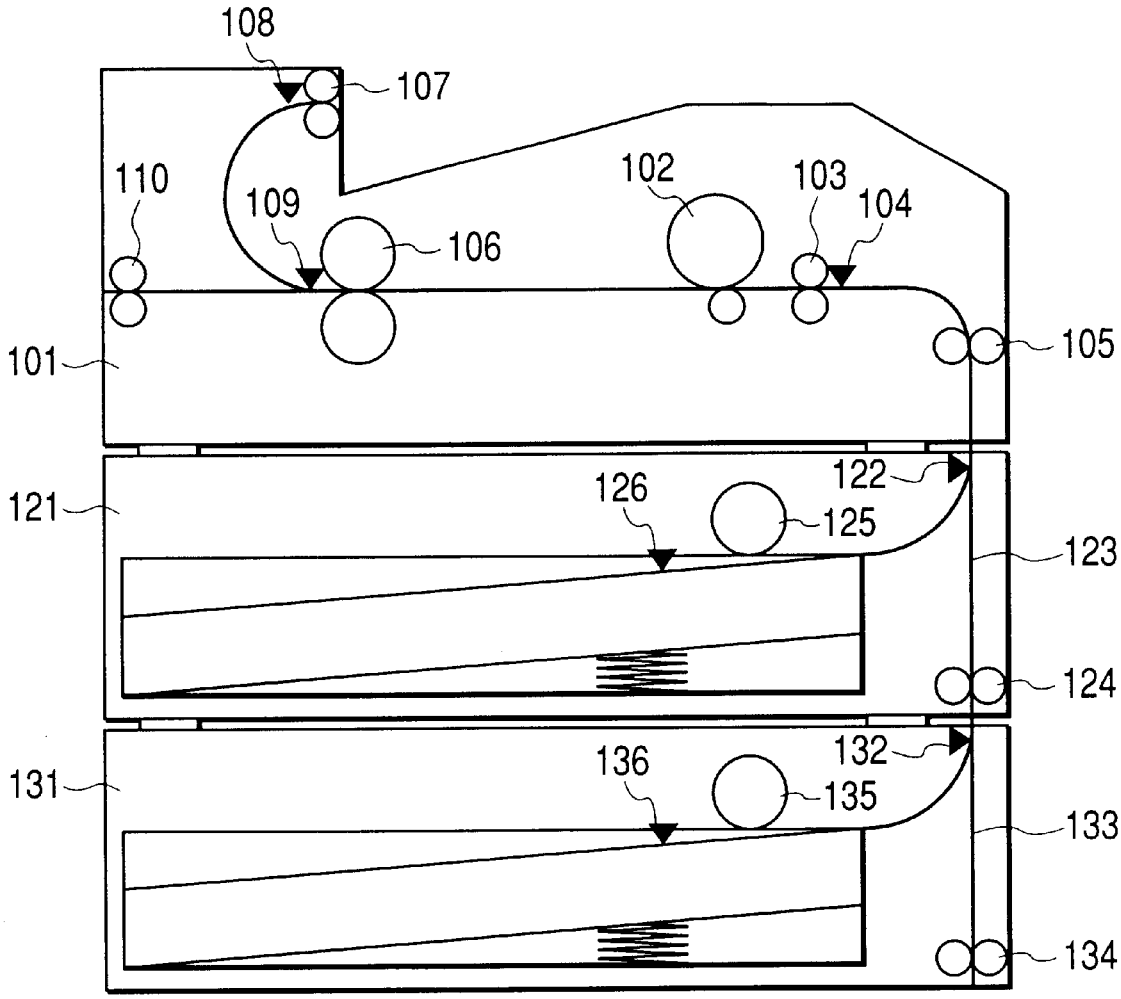
FIG. 1 is a schematic cross-sectional view of a paper feeding apparatus in Embodiment 1 of the present invention.

FIG. 1 is a schematic sectional view of the paper feeding apparatus in Embodiment 1 of the present invention.

A recording device body 101 is comprised of paper feeding rollers 105 for receiving and conveying a sheet sent from a paper feeding device 121 or 131, registration rollers 103 for alignment of the leading end of the sheet, a sensor 104 for detecting the leading end of the sheet for control of the rollers 103, a photosensitive drum 102 for formation of an image, fixing rollers 106 for fixing toner on the sheet, face-up discharge rollers 110, face-down discharge rollers 107, and sheet jam detecting sensors 108, 109.

On the other hand, the paper feeding device 121 and the paper feeding device 131 are constructed in the same structure and each device is comprised of a sheet pick-up roller 125, 135, a sheet presence/absence sensor 126, 136, conveying rollers 124, 134 for receiving and conveying a sheet conveyed from a downstream paper feeding device, and a sheet jam detecting sensor 122, 132.

Figure 2:
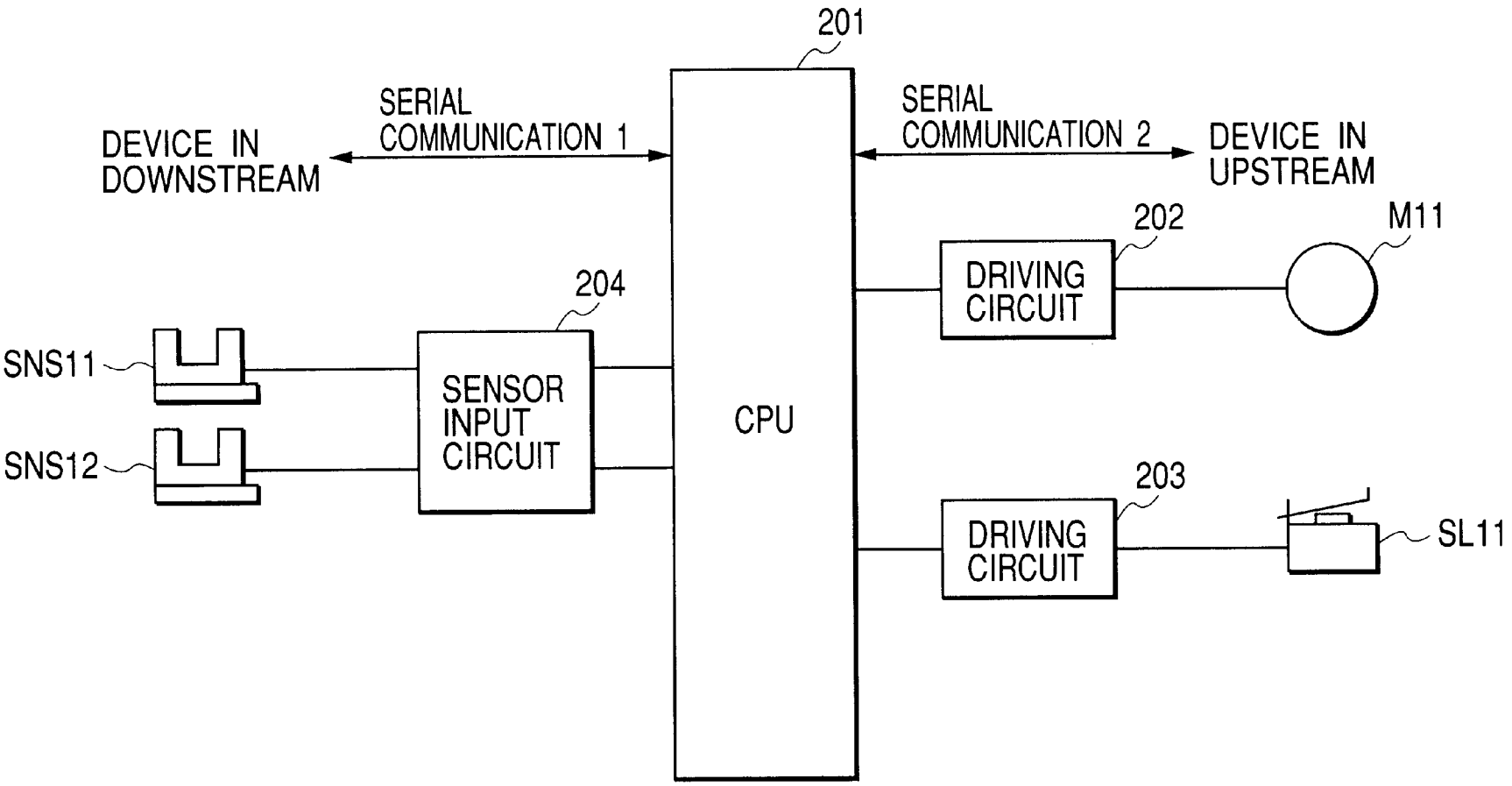
FIG. 2 is a block diagram showing an electrical configuration inside the paper feeding apparatus of Embodiment 1.

FIG. 2 is a block diagram showing an electrical configuration inside each of the above-stated paper feeding devices.

Reference numeral 201 designates a one-chip microcomputer incorporating ROM and RAM (hereinafter referred to as CPU 201), which sends a motor control signal to a driving circuit 202 for a sheet conveying motor M11, to control rotation and stop of the sheet conveying motor M11. The CPU 201 also sends a control signal to a driving circuit 203 for a pick-up solenoid SL11, to drive the solenoid SL11, thereby controlling pick-up of a sheet. Further, the CPU 201 accepts information from the sheet presence/absence sensor SNS11 and sheet jam detecting sensor SNS12 through a sensor input circuit 204 to monitor the sheet conveyance situation.

The CPU 201 can perform synchronous serial communication of two channels, by which it can exchange information through serial communication 2 with a device electrically connected upstream and through serial communication 1 with a device connected downstream. In the present embodiment, the paper feeding device 121 performs the serial communication with the recording device body 101 through the serial communication 2 and with the paper feeding device 131 through the serial communication 1. The paper feeding device 131 performs the serial communication with the paper feeding device 121 through the serial communication 2. If a further device is added downstream of the paper feeding device 131, the paper feeding device 131 will perform the serial communication with the additional device through the serial communication 1.

The paper feeding device 131 notifies the paper feeding device 121 that the device 131 itself has a one-stage tray, a sheet load capacity is 500 sheets, the type of sheets loaded at present is the A4 vertical size, and a current load is about 300 sheets. It is also notified that a monitor time of delay jam of paper feeding is one second. The paper feeding device 121 adds the number of trays of device's self (1 herein) to the number of trays of the paper feeding device 131 (1 herein) and merges device information of device's self into these information pieces received from the paper feeding device 131 to convert the information as if the devices seem a single paper feeding device, and transmits the information to the recording device body 101.

Namely, the device information that the paper feeding device 121 transmits to the recording device body 101 is that the number of trays (the sum of trays of the downstream devices) is 2, the load capacity of the tray No. 1 (the tray of device's self) is 500 sheets, the size of sheets now loaded is B5 vertical, the current load is about 400 sheets, the monitor time of delay jam of paper feeding is one second, the load capacity of the tray No. 2 (which is a tray number of the downstream paper feeding device; the tray number of the paper feeding device 131 is No. 2 when viewed from the paper feeding device 121; the tray number of the paper feeding device 131 is No. 1 when the paper feeding device 131 views the tray of its own) is 500 sheets, the size of sheets now loaded is A4 vertical, the current load is about 300 sheets, and the monitor time of delay jam of paper feeding is two seconds (the monitor time of 1 second sent from the paper feeding device 131+the monitor time of 1 second in the device's self 121).

When the recording device body 101 intends to effect printing on a sheet of the B5 size, the recording device body 101 issues a paper feed command to feed a sheet from the tray No. 1, to the paper feeding device 121. Receiving this command, the paper feeding device 121 analyzes the tray number, confirms that the tray number No. 1 indicates the tray of the device's self, and drives the sheet conveying motor M11 and pick-up solenoid SL11 to convey a sheet.

On the other hand, when the recording device body 101 intends to effect printing on a sheet of the A4 size, the recording device body 101 issues a paper feed command to feed a sheet from the tray No. 2, to the paper feeding device 121. Receiving this command, the paper feeding device 121 analyzes the tray number, confirms that this tray number No. 2 is not the tray number of device's self, and drives only the conveying motor M11. At the same time as it, it issues to the downstream paper feeding device 131 a paper feed command to designate as a tray number a value obtained by subtracting the number of trays of device's self from the value of the tray number in the paper feed command thus received, i.e., 2−1=1.

Receiving it, the paper feeding device 131 analyzes the tray number, confirms that this tray number indicates the tray of device's self, and drives the sheet conveying motor and pick-up solenoid (as shown in FIG. 2) to convey a sheet. The paper feeding device 121 receives the sheet of the A4 size sent from the paper feeding device 131 and then sends this sheet into the recording device body 101. If at this time the jam detecting sensor 122 fails to detect the leading end of the sheet even after a lapse of two seconds being the monitor time of delay jam of paper feeding from the tray No. 2, the paper feeding device 121 stops all the driving systems, judges it as a delay jam, and notifies the recording device body 101 of it.

Figure 3:
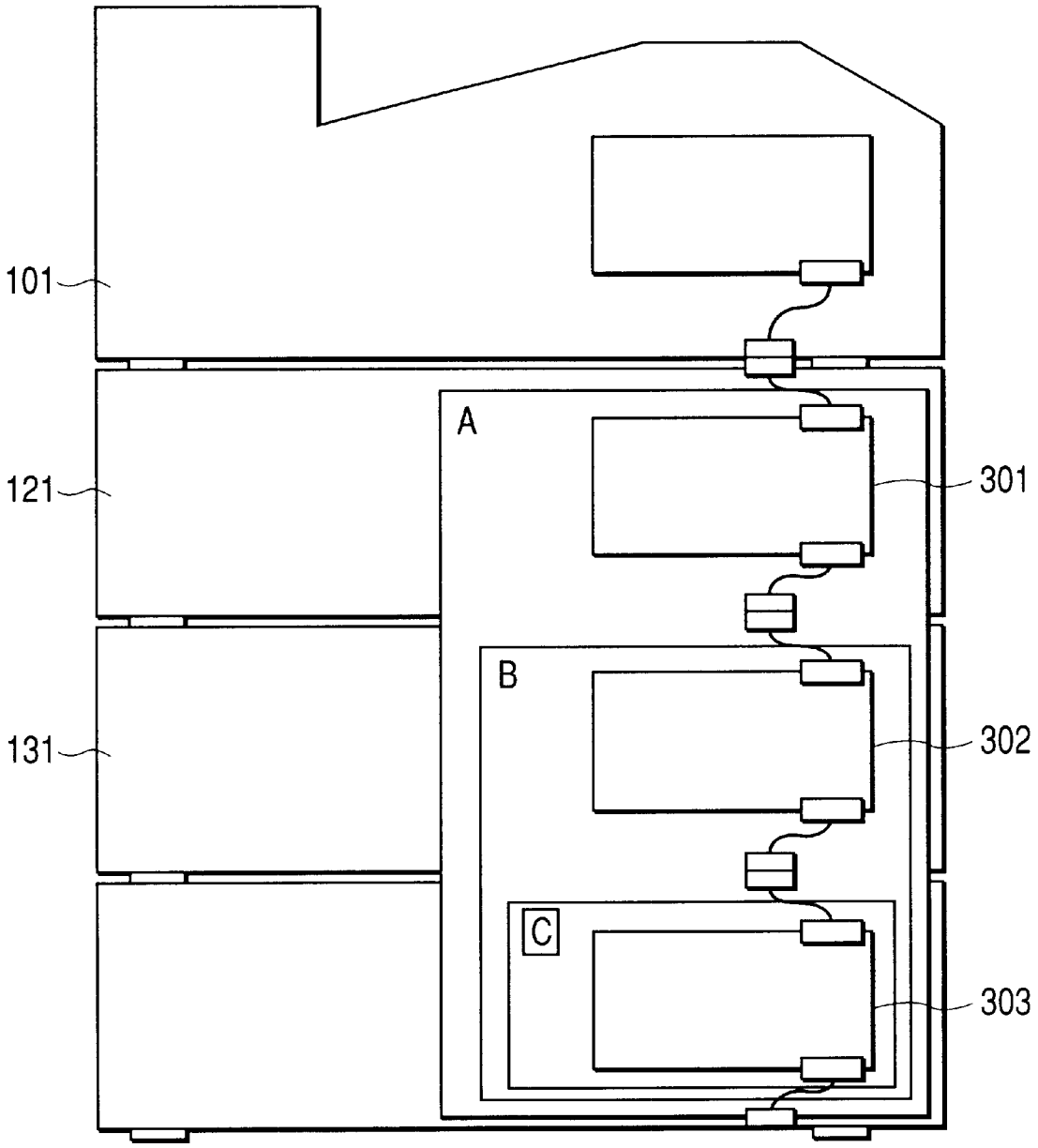
FIG. 3 is an explanatory drawing for conceptually explaining a control form according to the present invention.

The control form according to the present invention as conceptually shown in FIG. 3 can be established by the structure and control as described above. Namely, the downstreammost paper feeding device 303 controls only the device's self 303 as indicated by C, the paper feeding device 302 one upstream controls the device's self 302 and the downstream paper feeding device 303 as indicated by B, and the paper feeding device 301 further one upstream controls the device's self 301 and the downstream paper feeding device 302 as indicated by A.

This configuration realizes the form wherein the recording device body 101 is required to control only one closest downstream paper feeding device 301 even with any number of paper feeding devices added. The above configuration also realizes the form wherein any one paper feeding device is required to control only the device's self and one closest downstream paper feeding device even if a plurality of paper feeding devices are connected thereto downstream. It also realizes the form wherein the downstreammost paper feeding device is required to control only the device's self.

Figure 4:
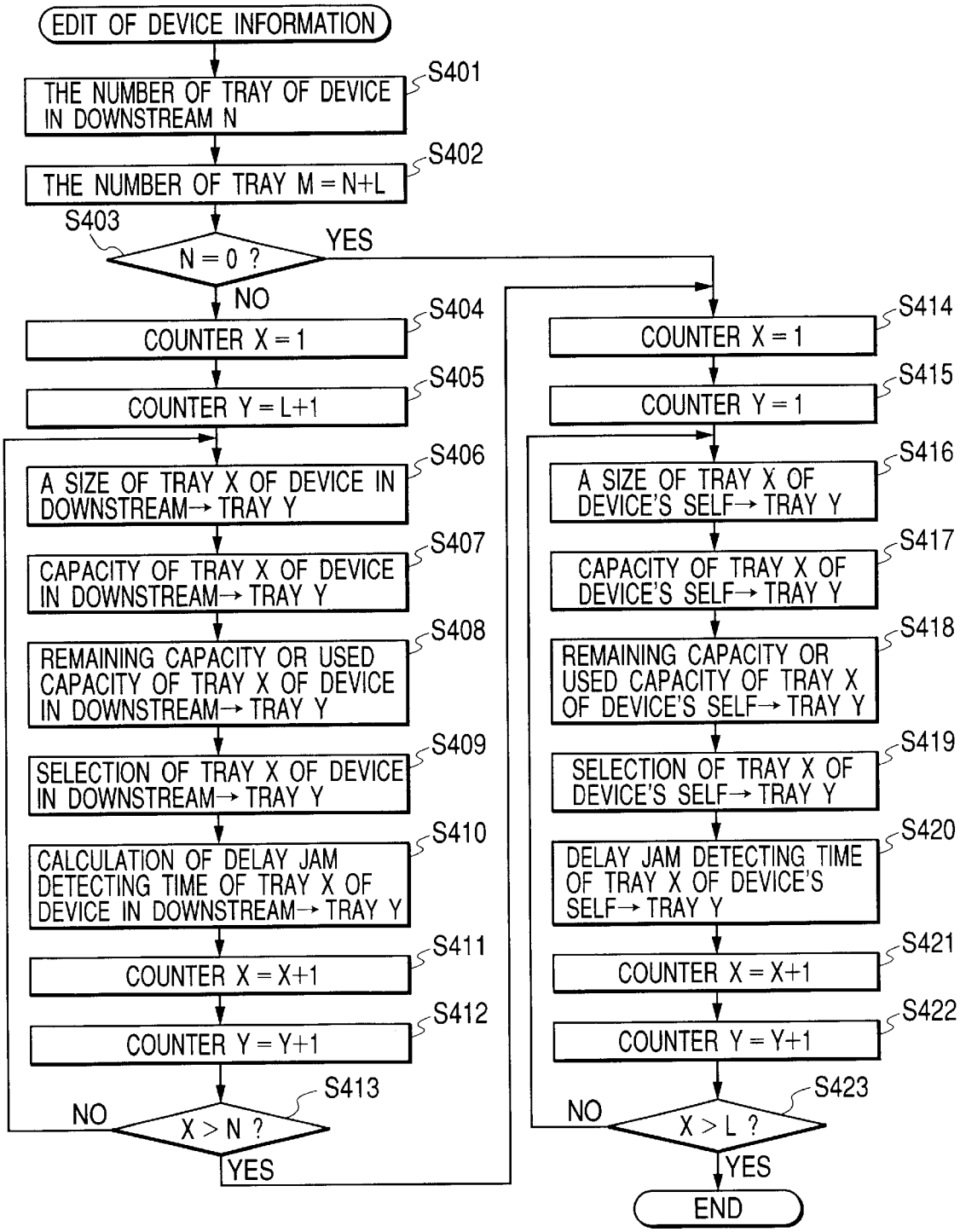
FIG. 4 is a flowchart showing control procedures for an edit of device information in Embodiment 1.
Figure 5:
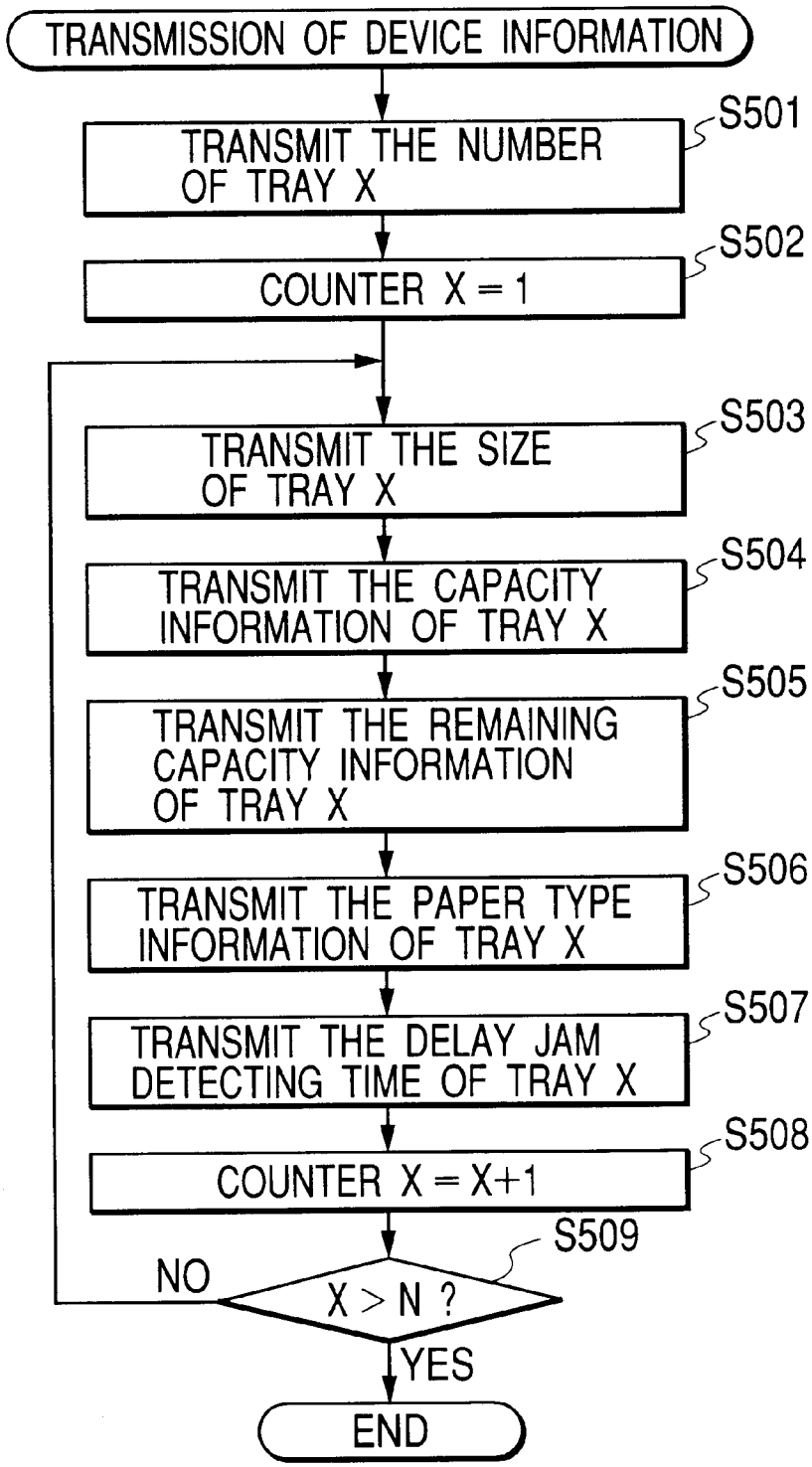
FIG. 5 is a flowchart showing control procedures for transmission of device information in Embodiment 1.
Figure 6:
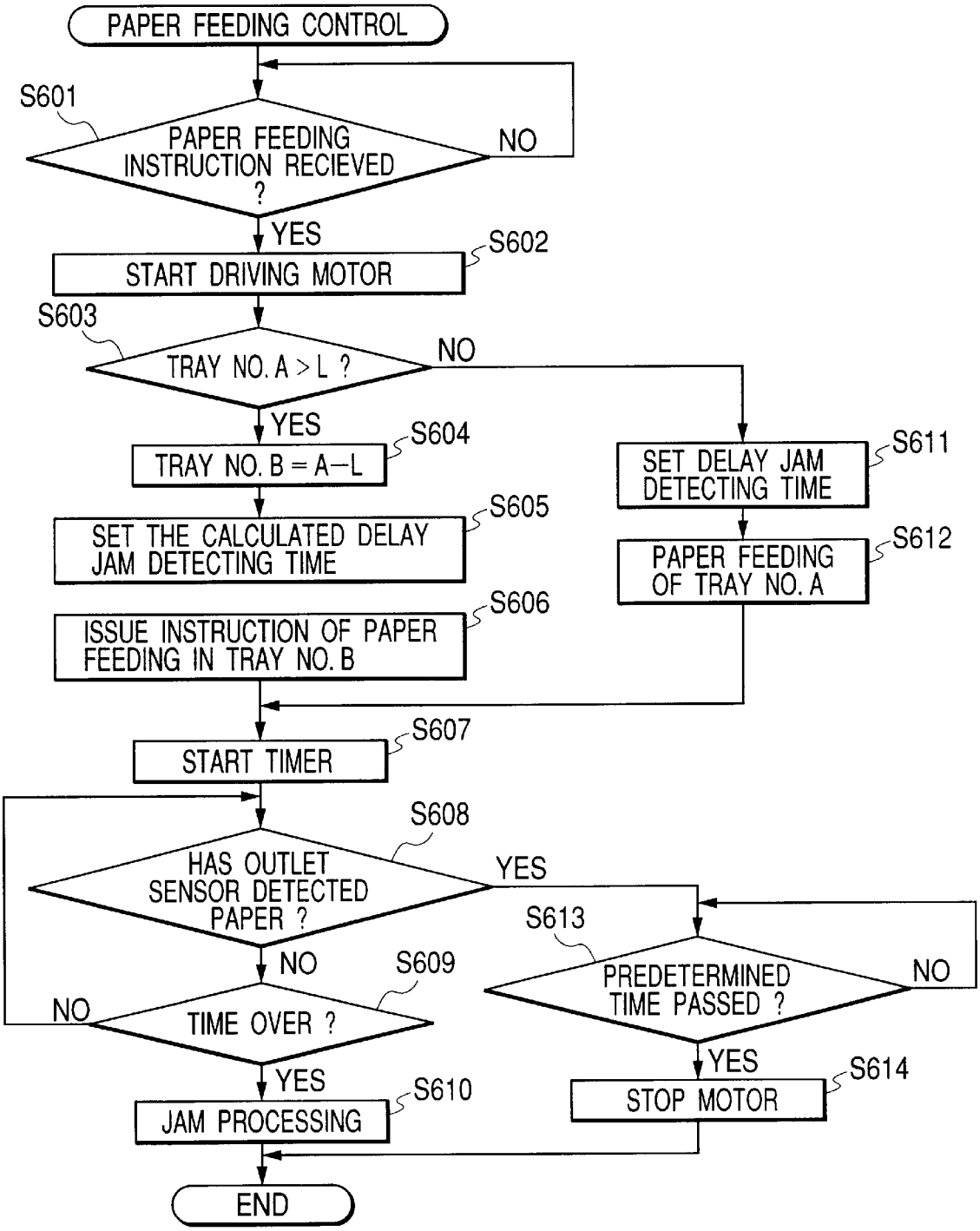
FIG. 6 is a flowchart showing control procedures for paper feeding control in Embodiment 1.

FIG. 4 to FIG. 6 are flowcharts showing the control procedures of the CPU 201 for carrying out the foregoing control in brief, and FIG. 4 shows the control procedures concerning the acquisition and edit of device information.

Step S401 is a step of checking the number of trays N of a downstream device sent therefrom and step S402 a step of adding the number of trays L (L is a natural number) of device's self to the number of trays N to calculate the sum of trays M including the device's self, which is to be transmitted to an upstream device. Step S403 is a step of judging whether the number of trays N thus checked is 0. If the number of trays is 0, it is determined that there is no downstream device connected, and the processes at and after step S414 are carried out. If the number of trays N is not 0, the CPU proceeds to the processes at and after step S404.

First, step S404 is a step of initializing the value of counter X to 1 in order to acquire the tray information of the downstream device, and step S405 a step of initializing the value of counter Y for storing edited tray information, to the value (L+1), which is the sum of the number of trays of device's self and 1. Subsequent step S406 is a step of storing a size of sheets loaded on the downstream tray No. X as information of the tray No. Y. Likewise, as to the tray No. X, step S407 is a step of storing the sheet load capacity of the tray No. X as information of the tray No. Y, step S408 a step of storing remaining sheets or a current sheet load as information of the tray No. Y, step S409 a step of storing a type of sheets loaded at present, as information of the tray No. Y, and step S410 a step of storing a delay jam detecting time as information of the tray No. Y, successively.

Step S411 is a step of incrementing the value of counter X by one and step S412 a step of incrementing the value of counter Y by one. Step S413 is a step of determining whether the incremented tray No. X is greater than the number of trays N sent from the downstream device. If it is not greater, the CPU returns to step S406 to repeat the processes for acquiring the next various tray information (steps S406 to S412). If the value of the incremented tray No. X is greater than the number of trays N sent from the downstream device, the CPU has already acquired all the tray information of the downstream device and thus goes to step S414 to perform the edit process of the tray information of device's self.

First, step S414 is a step of initializing the value of counter X to 1 in order to acquire the tray information of device's self and step S415 a step of initializing the value of counter Y for storing the edited tray information, to 1. Subsequent step S416 is a step of storing a size of sheets loaded on the tray No. X of device's self, as information of the tray No. Y. Likewise, as to the tray No. X, step S417 is a step of storing a sheet load capacity thereof, step S418 a step of storing remaining sheets or a current sheet load as information of the tray No. Y, step S419 a step of storing a type of sheets as information of the tray No. Y, and step S420 a step of storing a delay jam detecting time as information of the tray No. Y. successively.

Step S421 is a step of incrementing the value of counter X by one and step S422 a step of incrementing the value of counter Y by one. Step S423 is a step of determining whether the incremented tray No. X is greater than the number of trays L of device's self. If it is not greater, the CPU returns to step S416 to repeat the processes (steps S416 to S422) for acquiring the next tray information of the rest of device's self. If the value of the incremented tray No. X is equal to the number of trays L of device's self, the CPU has already acquired all the tray information of device's self and thus terminates the processing.

FIG. 5 is a flowchart showing the control procedures of the CPU 201 for transmitting the device information edited in the processing of FIG. 4 to the upstream device.

First, step S501 is a step of transmitting the total number of trays M including the number of trays of the downstream paper feeding device acquired at step S401. Step S502 is a step of initializing the value of counter X for transmitting each tray information, to 1. Subsequent step S503 is a step of transmitting the size information of sheets loaded on the tray No. X. Likewise, as to the tray No. X, step S504 is a step of transmitting the information of the sheet load capacity thereof, step S505 a step of transmitting the information of the remaining sheets or current sheet load thereof, step S506 a step of transmitting the information of the type of sheets, and step S507 a step of transmitting the delay jam detecting time of paper feeding.

Step S508 is a step of incrementing the value of counter X by one, and then the CPU proceeds to step S509 to determine whether the incremented tray No. X is greater than the total number of trays M. If it is not greater, the CPU returns to step S503 to repeat the processes (steps S503 to S508) for transmitting the next various tray information.

FIG. 6 is a flowchart showing the procedures of paper feeding control carried out by the CPU 201, based on a paper feed command transmitted from upstream.

Step S601 is a step of awaiting a paper feed command from the upstream device. Receiving the command, the CPU starts driving the conveying motor M11 at step S602. Step S603 is a step of determining whether the tray number A added to the paper feed command is greater than the number of trays L of device's self. If it is greater, the CPU goes to the processes at and after step S604. If is not greater on the other hand, the CPU performs the processes at steps S611, S612 described hereinafter and then goes to step S607.

Step S604 is a step of subtracting the number of trays L of device's self from the designated tray number A to convert it to a tray number B in the downstream paper feeding device. Then step S605 is a step of setting the delay jam detecting time of paper feeding calculated for the tray number A (the delay jam detecting time sent in the tray number B from the downstream paper feeding device+the delay jam detecting time in the device's self) and immediately thereafter, step S606 is a step of issuing a paper feed command in the tray number B to the downstream paper feeding device.

On the other hand, when the CPU proceeds to step S611, the CPU sets the delay jam detecting time of paper feeding in the device's self, because the paper feeding is that from the device's self. Subsequent step S612 is a step of driving the pick-up solenoid SL11 to start the paper feeding operation of the tray number A.

Step S607 is a step of starting a timer for control of conveyance and step S608 is a step of determining whether the exit sensor has detected the leading end of a sheet sent from the downstream paper feeding device or a sheet fed from the device's self. If it has detected the CPU moves to step S613 to await a lapse of a predetermined time (a time for conveyance of the length of the sheet), or detection of the rear end of the sheet (not illustrated). After a lapse of the predetermined time or after the detection, the CPU goes to step S614 to stop the motor, and terminates the processing.

On the other hand, if at step S608 the leading end of a sheet is not detected, the CPU goes to step S609 to check the timer value and determine whether it is over the delay jam detecting time. If it is not over the detecting time, the CPU returns to step S608. if it is over the detecting time, the CPU goes to step S610 to perform jam processing, and then terminates the processing. In this jam processing all the driving systems are stopped and the upstream device and downstream device are notified of occurrence of a jam.

Execution of the control of the present embodiment as described above presents the effect of facilitating the device control from the recording device body side, because all the paper feeding devices viewed from an upstream device can be always recognized as a single device even if a plurality of paper feeding devices are connected to the recording device body.

Embodiment 2

Figure 7:
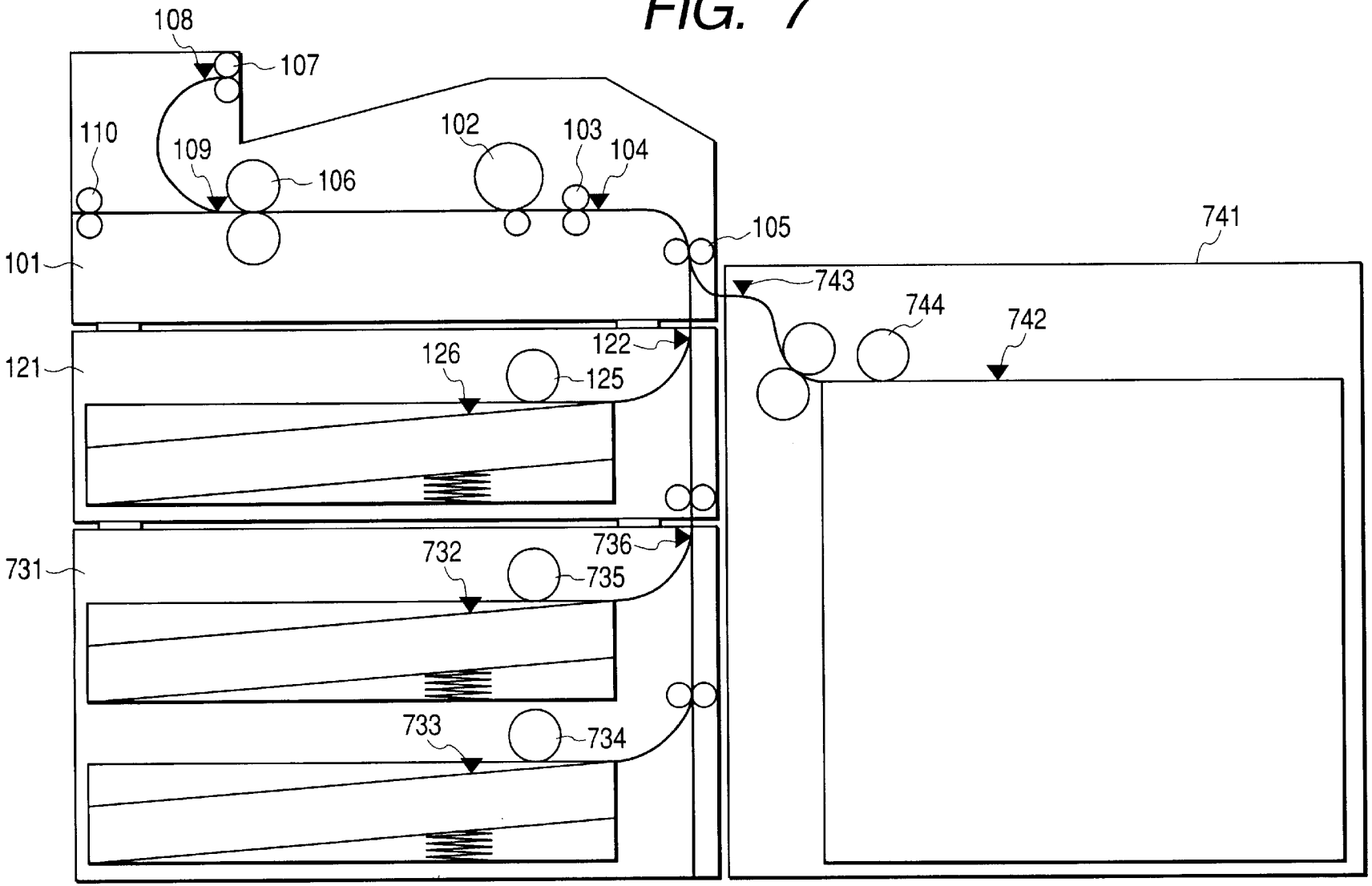
FIG. 7 is a schematic cross-sectional view of a paper feeding apparatus in Embodiment 2 of the present invention.

FIG. 7 is a schematic sectional view of the paper feeding apparatus in Embodiment 2 according to the present invention.

FIG. 7 shows a configuration wherein the recording device body 101 is provided with a paper feeding device 731 having two stages of paper feeding trays below the paper feeding device 121 described in Embodiment 1 (FIG. 1) and further provided with a large capacity paper feeding device 741 having a conveyance path different from those of the paper feeding device 121 and paper feeding device 731 and having a large-capacity paper feeding tray of 2000 sheets. Reference numerals 732, 733, 742 represent respective sheet presence/absence sensors in corresponding trays, reference numerals 734, 735, 744 respective pick-up rollers for picking up a sheet from the corresponding trays, and reference numerals 736, 743 respective jam detecting sensors.

The electrical connection is cascade connection in the order of the recording device body 101→paper feeding device 121→paper feeding device 731→large-capacity paper feeding device 741 from the upstream side. The electrical connection and conveyance path connection of the large-capacity paper feeding device 741 are not automatically determined by the physical device connection, different from the paper feeding device 121 and the paper feeding device 731. The large-capacity paper feeding device 741 is electrically connected through an external interface cable (not illustrated) to the paper feeding device 731 and the conveyance path thereof is connected to the conveyance path of the recording device body 101 from the side face thereof.

In the above configuration, the large-capacity paper feeding device 741 transmits to the electrically upstream paper feeding device 731 various device information including 1 as the number of trays, the A4 size as information about the size of sheets loaded on the tray No. 1, 2000 sheets as the sheet capacity thereof, 1500 sheets as the current load thereof, plain paper as the type of sheets thereon, and one second as the delay jam detecting time thereof. The paper feeding device 731 transmits to the electrically upstream paper feeding device 121 various device information including 3 as the number of trays, the B5 size as information about the size of sheets loaded on the tray No. 1, 500 sheets as the sheet capacity of tray No. 1, 300 sheets as the current load of tray No. 1, plain paper as the type of sheets on tray No. 1, one second as the delay jam detecting time of tray No. 1, the A5 size as information about the size of sheets loaded on the tray No. 2, 500 sheets as the sheet capacity of tray No. 2, 400 sheets as the current load of tray No. 2, plain paper as the type of sheets on tray No. 2, two seconds as the delay jam detecting time of tray No. 2, the A4 size as information about the size of sheets loaded on the tray No. 3, 2000 sheets as the sheet capacity of tray No. 3, 1500 sheets as the current load of tray No. 3, plain paper as the type of sheets on tray No. 3, and one second as the delay jam detecting time of tray No. 3.

Here the large-capacity paper feeding device 741 is structurally connected directly to the recording device body 101 and, in order to indicate the possession of the independent conveyance path different from that of the upstream paper feeding device 731, it notifies the paper feeding device 731 of a conveyance number #1 and mark information indicating discontinuity of conveyance path, as tray information. This notification process can be added to between steps S409 and S410 in FIG. 4 and to between steps S506 and S507 in FIG. 5.

In the device information edit process and the device information transmission process thus corrected, the paper feeding device 731 determines that it has no sheet conveyance path continuous to a further downstream device and has the conveyance path independent from that of the large-capacity paper feeding device 741 from the conveyance path information in the tray information from the downstream large-capacity paper feeding device 741. Then step S410 of FIG. 4 is corrected, whereby the data is transmitted to the paper feeding device 121 without adding the delay jam detecting time of device's self to the delay jam detecting time of paper feeding sent from the large-capacity paper feeding device 741. Further, the paper feeding device 731 notifies the recording device body 101 of the information about the conveyance path number #2 (with the conveyance path coupling mark) of the tray No. 1 and the tray No. 2 and the conveyance path number #1 (without the conveyance path coupling mark) of the tray No. 3.

Similar processing to the above is also carried out in the paper feeding device 121.

As a result, the recording device body 101 recognizes the tray numbers of the respective paper feeding trays as follows: the tray number of the paper feeding device 121 is identified as No. 1; the tray number of the upper tray of the paper feeding device 731 as No. 2; the tray number of the lower tray of the paper feeding device 731 as No. 3; the tray number of the large-capacity paper feeding device 741 as No. 4. Thus it seems to the recording device body 101 that a single paper feeding apparatus provided with trays of the tray numbers No. 1 to No. 4 is connected thereto. It is also clarified that the trays No. 1, No. 2, and No. 3 are associated with the coupled conveyance paths having the conveyance path number #2 and that the tray No. 4 is associated with the independent conveyance path having the conveyance path number #1.

The present invention can also be applied to configurations wherein a plurality of sheet conveyance paths are formed by a plurality of paper feeding devices as described above, and provides the effect of facilitating the device control from the recording device body side, because all the paper feeding devices viewed from an upstream device can be always recognized as a single device.

Embodiment 3

Figure 8:
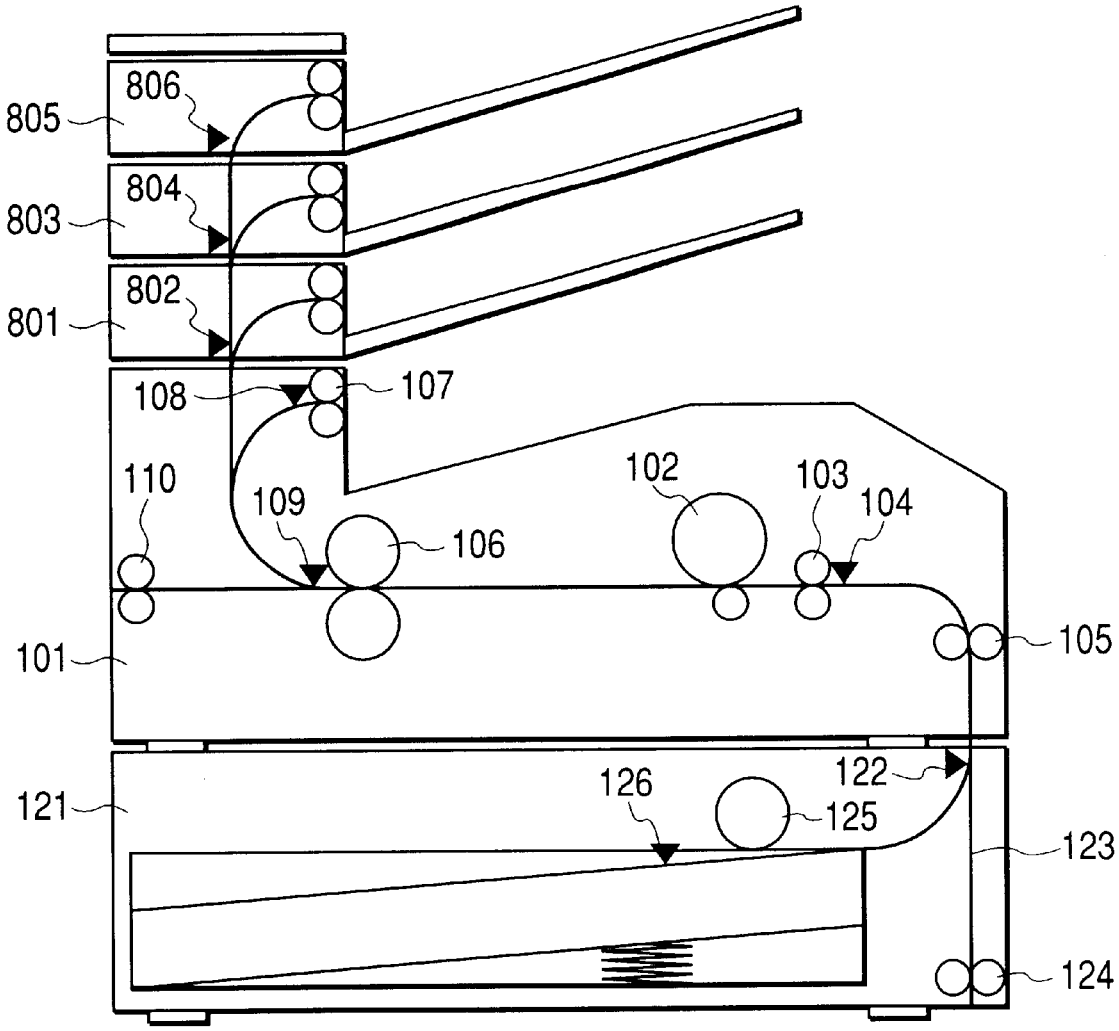
FIG. 8 is a schematic cross-sectional view of a paper discharging apparatus in Embodiment 3 of the present invention.

The present invention can also be applied to paper discharging apparatus, as well as the paper feeding apparatus, and structures similar to those in Embodiment 1 and Embodiment 2 can be adopted. FIG. 8 is a schematic sectional view of the paper discharging apparatus in Embodiment 3 of the present invention.

The paper discharging device 801, paper discharging device 803, and paper discharging device 805 have the same structure and each of them is comprised of a flapper (not shown) for switching between conveyance paths to paper discharge rollers and an entrance sensor 802, 804, or 806.

Figure 9:
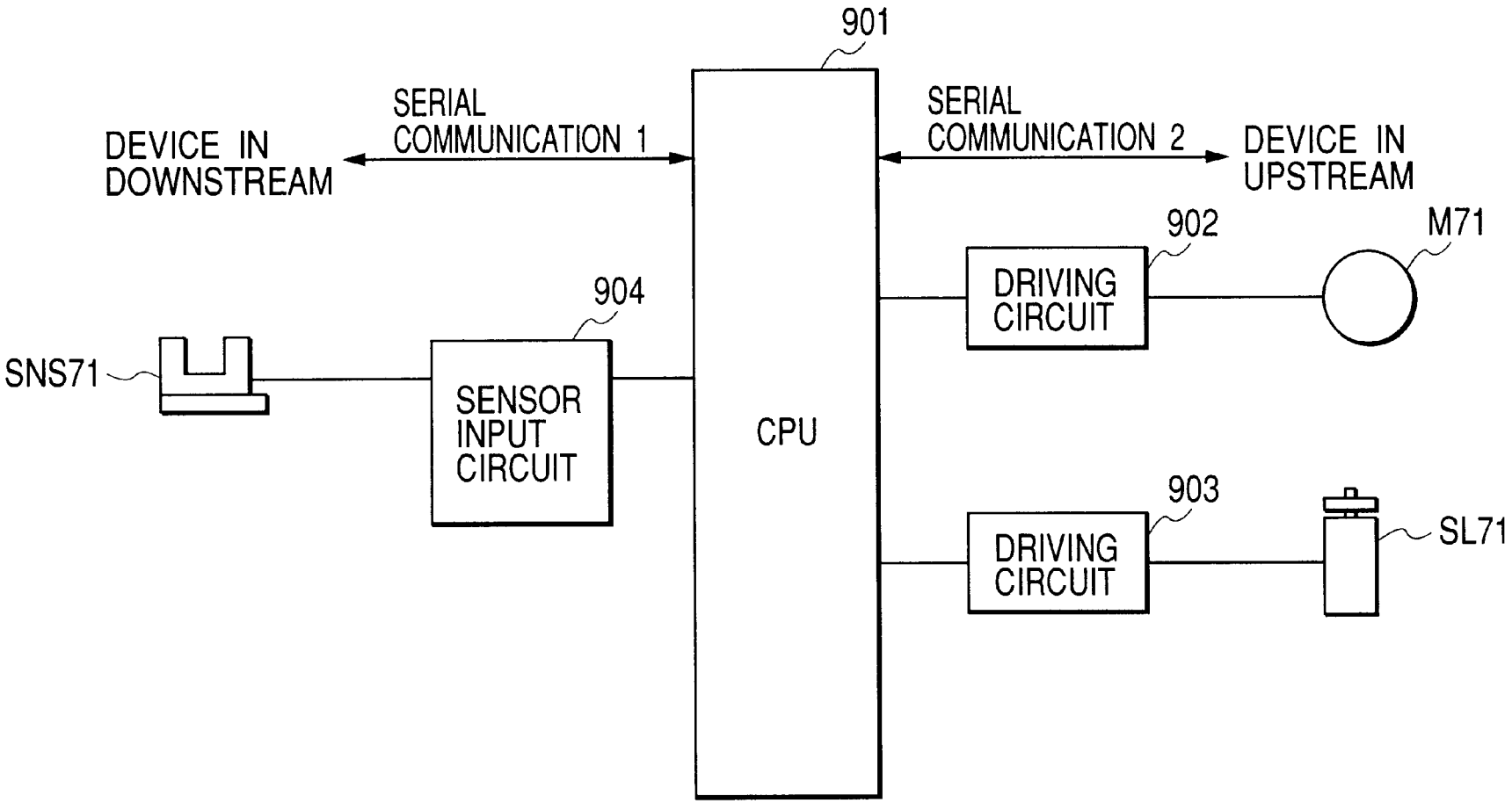
FIG. 9 is a block diagram showing an electrical configuration inside the paper discharging apparatus of Embodiment 3.

FIG. 9 is a block diagram showing an electrical configuration inside each of the above paper discharging devices.

Reference numeral 901 designates a one-chip microcomputer incorporating ROM and RAM (hereinafter referred to as CPU 901), which sends a motor control signal to a driving circuit 902 for a sheet conveying motor M71, to control rotation and stop of the sheet conveying motor M71. The CPU 901 also sends a control signal to a driving circuit 903 for a flapper solenoid SL71, to drive the solenoid SL71, thereby controlling switching between the paper conveyance paths. Further, the CPU 901 accepts information from a paper discharge sensor SNS71 through a sensor input circuit 904 to monitor the sheet conveyance situation.

The CPU 901 can perform the synchronous serial communication of two channels, by which it can exchange information through serial communication 2 with a device electrically connected upstream and through serial communication 1 with a device connected downstream. In the present embodiment, the paper discharging device 801 performs the serial communication with the recording device body 101 through the serial communication 2 and the serial communication with the paper discharging device 803 through the serial communication 1. The paper discharging device 803 performs the serial communication with the paper discharging device 801 through the serial communication 2 and with the paper discharging device 805 through the serial communication 1. The paper discharging device 805 performs the serial communication with the paper discharging device 803 through the serial communication 2. If a further device is added to the downstream side of the paper discharging device 805, the paper discharging device 805 will perform the serial communication with the additional device through the serial communication 1.

The paper discharging device 805 notifies the paper discharging device 803 that the device 805 itself has a one-stage tray, the sheet load capacity is 200 sheets, and the current load is about 100 sheets. It is also notified that the discharge completion time is 0.5 second. The paper discharging device 803 adds 1 as the number of trays of device's self to 1 as the number of trays of the paper discharging device 805 while merging the device information of device's self to these information pieces received from the paper discharging device 805, to convert the information as if the devices seem a single paper discharging device, and then transmits the information to the paper discharging device 801. Further, the paper discharging device 801 adds 1 as the number of trays of device's self to 2 as the number of trays from the paper discharging device 803 while merging the device information of device's self to these information pieces received from the paper discharging device 803, to convert the information as if the devices seem a single paper discharging device, and then transmits the information to the recording device body 101.

Namely, the device information that the paper discharging device 801 transmits to the recording device body 101 is that the number of trays is 3, the load capacity of the tray No. 1 (the tray of device's self) is 200 sheets, the current load thereon is about 30 sheets, the discharge completion time thereof is one second; the load capacity of the tray No. 2 (the tray of the downstream device) is 200 sheets, the current load thereon is about 50 sheets, the discharge completion time thereof is one second (the discharge completion time of 0.5 second sent from the paper discharging device 803+the discharge completion time of 0.5 second in device's self); the load capacity of the tray No. 3 (the tray of the downstreammost device) is 200 sheets, the current load thereon is about 100 sheets, the discharge completion time thereof is 1.5 seconds (the discharge completion time of 1 second sent from the paper discharging device 803+the discharge completion time of 0.5 second in device's self).

When a sheet after print by the recording device body 101 is discharged by the paper discharging device 801, the recording device body 101 issues a paper discharge command to discharge the sheet onto the tray No. 1, to the paper discharging device 801. Receiving the command, the paper discharging device 801 analyzes the tray number, confirms that this tray number No. 1 is the tray of device's self, and drives the sheet conveying motor M71 and flapper solenoid SL71 to discharge the sheet in the device's self.

On the other hand, when a sheet after print by the recording device body 101 is discharged by the paper discharging device 805, the recording device body 101 issues a paper discharge command to discharge the sheet onto the tray No. 3, to the paper discharging device 801. Receiving it, the paper discharging device 801 analyzes the tray number, confirms that this tray number No. 3 downstream is not the tray number of device's self, and drives only the conveying motor M71. At the same time as it, the paper discharging device 801 issues to the paper discharging device 803 a paper discharge command to designate as a tray number a value obtained by subtracting the number of trays of device's self from the tray number in the paper discharge command thus received, i.e., 3−1=2.

Receiving it, the paper discharging device 803 analyzes the tray number, confirms that this tray number is not the tray number of device's self, and drives only the conveying motor M71. At the same time as it, the paper discharging device 803 issues to the downstream paper discharging device 805 a paper discharge command to designate as a tray number a value obtained by subtracting the number of trays of device's self from the value of the tray number in the paper discharge command thus received, i.e., 2−1=1.

Receiving it, the paper discharging device 805 analyzes the tray number, confirms that this tray number is the tray of device's self, and drives the sheet conveying motor and flapper solenoid (as shown in FIG. 9) to convey the sheet and discharge it in the device's self. The paper discharging device 801 receives the sheet sent from the recording device body and delivers the sheet into the paper discharging device 803. The paper discharging device 803 receives the sheet sent from the paper discharging device 801 and delivers this sheet into the paper discharging device 805. If at this time the recording device body 101 fails to receive discharge completion notification within the discharge completion time sent from the paper discharging device 801, it will stop all the driving systems and judge the situation as a stay jam.

In the paper discharging apparatus of the present embodiment, similar to the foregoing paper feeding apparatus, when the device receives no notification of completion of discharge within the discharge completion time received from the downstream device, the device also judges it as a delay jam and notifies the recording device body 101 of the stay jam.

Figure 10:
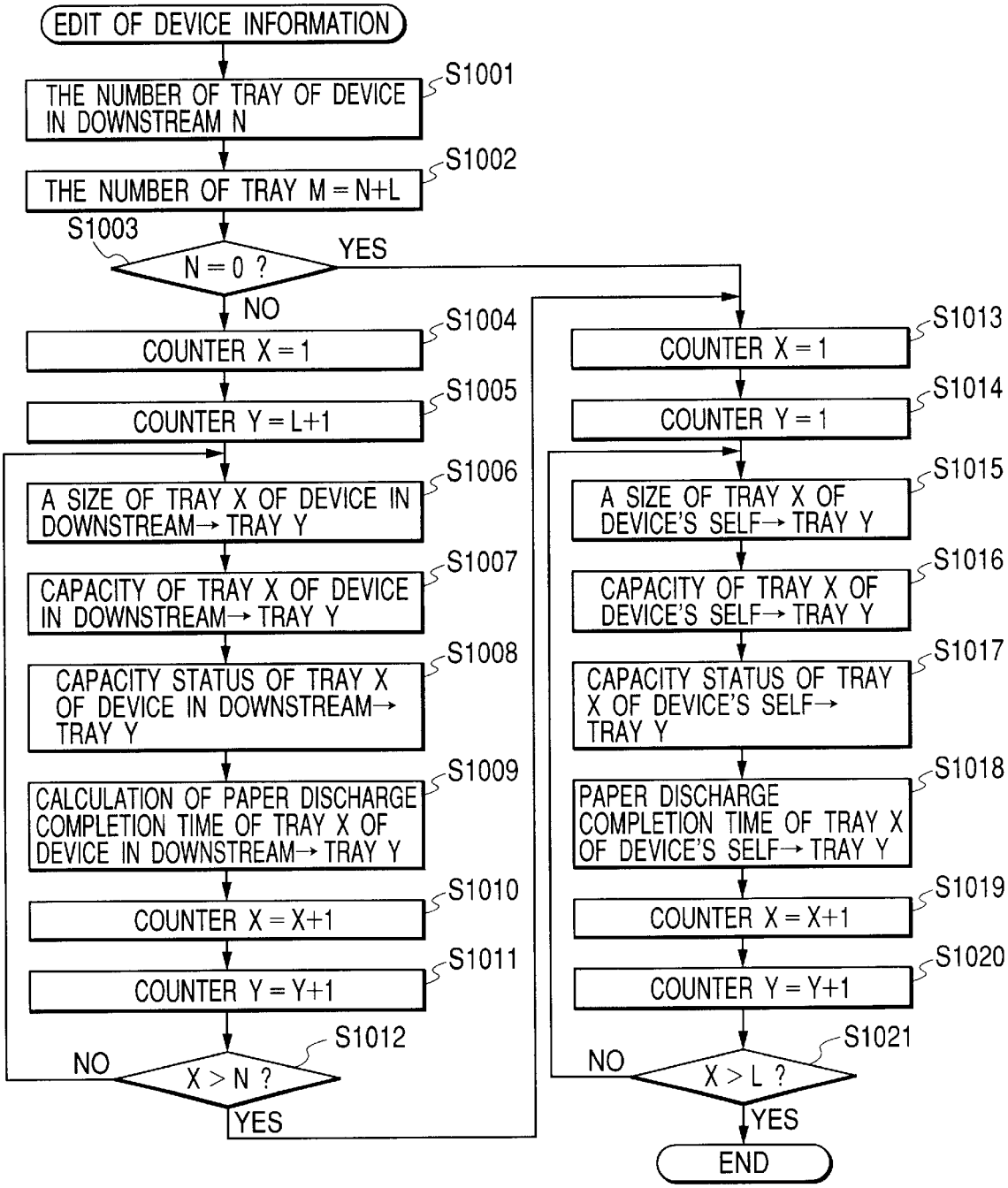
FIG. 10 is a flowchart showing control procedures for an edit of device information in Embodiment 3.
Figure 11:
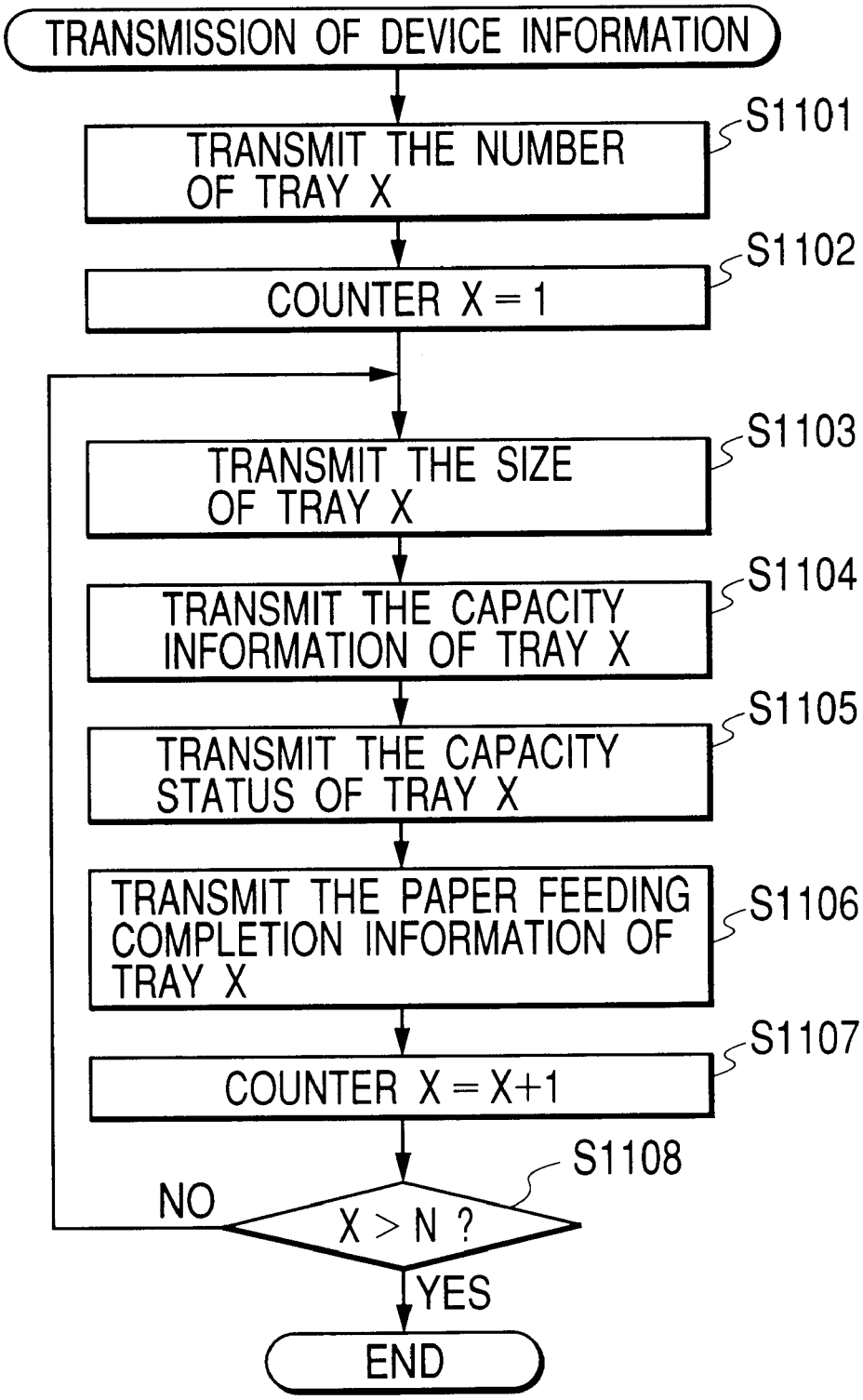
FIG. 11 is a flowchart showing control procedures for transmission of device information in Embodiment 3.

FIG. 10 to FIG. 12 are flowcharts showing the control procedures of the CPU 901 for executing the foregoing control in brief. FIG. 10 shows the control procedures concerning acquisition of device information. This algorithm of the control procedures is basically similar to that of the control procedures for the edit of device information in the paper feeding apparatus shown in FIG. 4, and thus the detailed description thereof is omitted herein.

In the flowchart herein, however, the contents of the tray information are different in part: at steps S1006, S1015 the function of the device is edited; at steps S1007, S1016 the load capacity of the tray is edited; at steps S1008, S1017 the load situation (current load) of the tray is edited; at steps S1009, S1018 the discharge completion time is edited. The function indicated at steps S1006, S1015 is a function that the paper discharging device has, which is simple stacking in the example of the present embodiment but which can b e an offset function, a staple function, a punch function, a gluing function, and/or a saddle stitch function, depending upon the paper discharging devices.

FIG. 11 is a flowchart showing the control procedures of the CPU 901 for transmitting the device information edited in the processing of FIG. 10, to an upstream device. This algorithm of the control procedures is basically similar to that of the control procedures for transmission of the device information in the paper discharging apparatus shown in FIG. 5, and thus the detailed description thereof is omitted herein.

In the flowchart herein, however, the contents of the tray information are different in part: at step S1103 the function of the device is transmitted; at step S1104 the load capacity of the tray is transmitted; at step S1105 the load situation (current load) of the tray is transmitted; at step S1106 the discharge completion time is transmitted.

FIG. 12 is a flowchart showing the procedures for control of paper discharge carried out by the CPU 901, based on a paper discharge command transmitted from upstream.

Step S1201 is a step of awaiting reception of a paper discharge command from the upstream device. Receiving the command, the CPU drives the conveying motor M71 at step S1202. Step S1203 is a step of determining whether the tray number A added to the paper discharge command is greater than L as the number of trays of device's self. If it is greater, the CPU goes to the processes at and after step S1204. On the other hand, if it is not greater, the CPU first executes steps S1215, S1216 described hereinafter and then goes to step S1207.

Step S1204 is a step of subtracting L as the number of trays of device's self from the designated tray number A to convert it into a tray number B in the downstream paper discharging device. Subsequent step S1205 is a step of calculating and setting the discharge completion time upon discharge in the tray number A (the discharge completion time sent in the tray number B from the downstream paper discharging device+the discharge completion time in the device's self), and step S1206 immediately thereafter is a step of issuing a paper discharge command in the tray number B to the downstream paper discharging device.

On the other hand, when the CPU goes to step S1215, the discharge completion time in the device's self is set because of the paper discharge into the device's self. Subsequent step S1216 is a step of driving the flapper solenoid SL71 to start the paper discharge operation in the tray number A.

Step S1207 is a step of watching a result of detection of a sheet by the entrance sensor and awaiting actual conveyance of the sheet into the device. When the sheet is detected, the CPU starts a timer for control of conveyance at step S1208. Subsequent step S1209 is a step of waiting for a predetermined time (a time necessary for the discharge of the sheet, or a time necessary for delivering the sheet into the downstream device). After a lapse of the predetermined time, the CPU stops the motor at step S1210 and goes to step S1211.

Step S1211 is a step of again determining whether the tray number A added to the paper discharge command is greater than L as the number of trays of device's self. If it is not greater, the command is one for discharge into device's self and thus the CPU goes to step S1217 to notify the upstream device of completion of discharge, and then terminates the processing. If A is greater than L on the other hand, the CPU goes to the processes at and after step S1212.

Step S1212 is a step of determining whether the discharge completion notification is received from the downstream device. If it is received, the CPU goes to step S1217 to notify the upstream device of completion of discharge, and then terminates the processing. If it is not received on the other hand, the CPU goes to step S1213 to check the timer value to determine whether the time is over the discharge completion time. If the time is not over the discharge completion time, the CPU returns to step S1212. If it is over the discharge completion time, the CPU goes to step S1214 to perform the jam processing, and then terminates the processing. In this jam processing all the driving systems are terminated and the upstream device and downstream device are notified of occurrence of a jam.

Execution of the control of the present embodiment as described above presents the effect of facilitating the device control from the recording device body side, because the paper discharging devices from the upstream device can be always recognized as a single device even if a plurality of paper discharging devices are connected to the recording device body.

Embodiment 4

Figure 13:
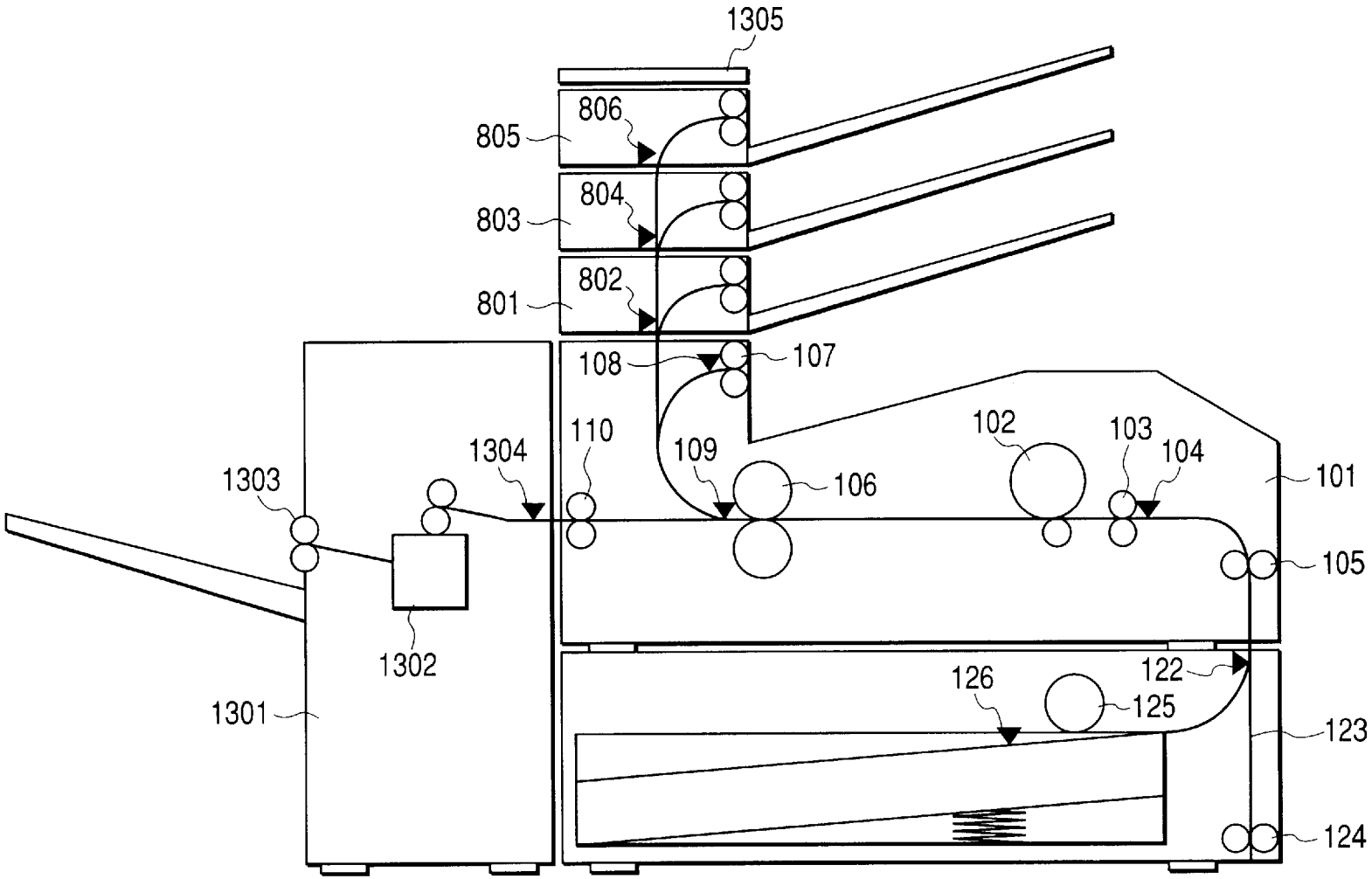
FIG. 13 is a schematic cross-sectional view of a paper discharging apparatus in Embodiment 4 of the present invention.

FIG. 13 is a schematic sectional view of the paper discharging apparatus in Embodiment 4 of the present invention.

FIG. 13 shows a configuration wherein, in addition to the paper discharging devices 801, 803, 805 described in Embodiment 3 (FIG. 8), a 2000-sheet staple stacker discharging device 1301 having another conveyance path different from those of the foregoing devices is connected to the recording device body 101. Reference numeral 1302 designates a staple unit, reference numeral 1303 paper discharging rollers, and reference numeral 1304 an entrance sensor. Reference numeral 1305 denotes a conveyance path end plate. When the paper discharging device 805 detects the conveyance path end plate 1305, it can judge that the conveyance path ends there.

The electrical connection is cascade connection in the order of the recording device body 101→paper discharging device 801→paper discharging device 803→paper discharging device 805→paper discharging device 1301 from the upstream side. The electrical connection and the conveyance path connection of the paper discharging device 1301 are not automatically determined by the physical device connection, different from the paper discharging devices 801, 803, 805. The paper discharging device 1301 is electrically connected through an external interface cable to the paper discharging device 805, but the conveyance path thereof is connected to a face-up discharge port of the recording device body 101.

In the above configuration, the paper discharging device 1301 transmits to the electrically upstream paper discharging device 805 various device information including 1 as the number of trays, 2000 sheets as the sheet load capacity of the tray No. 1, 1500 sheets as the current load thereon, possession of the staple function, and 5 seconds as the discharge completion time, according to the flows of FIG. 10 and FIG. 11. In addition to these tray information pieces, the paper discharging device 1301 further transmits a conveyance path number #1 and absence of a conveyance path coupling mark (a mark indicating absence of coupling in order to clarify presence/absence of coupling). This process can be added to between steps S1008 and S1009 in FIG. 10.

The paper discharging device 805 transmits to the electrically upstream paper discharging device 803 various device information including 2 as the number of trays, 200 sheets as the sheet load capacity of the tray No. 1, 100 sheets as the current load thereon, possession of the simple stacking function, 0.5 second as the discharge completion time for the tray No. 1, 2000 sheets as the sheet load capacity of the tray No. 2, 1500 sheets as the current load on the tray No. 2, possession of the staple function, and 5 seconds as the discharge completion time for the tray No. 2.

Since at this time the paper discharging device 805 detects the end of the sheet conveyance path, it judges that the downstream paper discharging device 1301 has the independent conveyance path, and then transmits the data to the paper discharging device 803 without adding the discharge completion time of device's self to the discharge completion time sent from the paper discharging device 1301. The paper discharging device 805 also transmits to the paper discharging device 803 such information that the tray No. 1 has the conveyance path number #2 (with the conveyance path coupling mark) and the tray No. 2 the conveyance path number #1 (without the conveyance path coupling mark). After that, processing similar to the above is also carried out in the paper discharging device 801.

As a result, the recording device body recognizes the tray numbers of the respective discharge trays as follows: the tray number of the paper discharging device 801 is identified as No. 1; the tray number of the paper discharging device 803 as No. 2; the tray number of the paper discharging device 805 as No. 3; the tray number of the paper discharging device 1301 as No. 4. Thus it seems to the recording device body that a single paper discharging device having the trays of the tray numbers No. 1 to No. 4 are connected to the body. It is also clarified that the trays No. 1, No. 2, and No. 3 are associated with the coupled conveyance paths of the conveyance path number #2 and the tray No. 4 is associated with the independent conveyance path of the conveyance path number #1.

The present invention can also be applied to configurations wherein a plurality of paper discharging devices form a plurality of sheet conveyance paths as described above, and presents the effect of facilitating the device control from the recording device body side, because the paper discharging devices from the upstream device can be always recognized as a single device.

What is claimed is:

1. A paper feeding apparatus used in electrical cascade connection of plural paper feeding devices with an external device, and comprising a first communication means for communication between an electrically downstream paper feeding device and the apparatus itself and a second communication means for communication between an electrically upstream paper feeding device and the apparatus itself, said apparatus comprising:

a means for acquiring device information concerning said downstream device through said first communication means;

a first control means for controlling the upstream device by converting said acquired device information concerning the downstream device and device information of the apparatus itself together into device information as a single device, and transmitting to said upstream device by means of said second communication means; and a means for analyzing control information from said upstream device and transmitting control information through the apparatus itself to said downstream device, which is second control means for controlling the apparatus itself, based on information concerning the apparatus itself out of said control information, and transmitting information concerning said downstream device through said first communication means to said downstream device according to said control information.

2. A paper feeding apparatus according to claim 1, wherein said second control means comprises a separating means for separating said device information concerning said downstream device from said control information.

3. A paper feeding apparatus according to claim 1, comprising a means for automatically effecting electrical connection with the upstream device and downstream device when physically connected to said upstream device and downstream device, wherein a sheet conveyance path from said upstream device to said downstream device is uniquely determined by said physical connection.

4. A paper feeding apparatus according to claim 1, comprising a means for effecting physical connection with said upstream device and downstream device and means for effecting electrical connection with said upstream device and downstream device independently of each other, wherein each paper feeding device comprises an independent sheet conveyance path to said external device.

5. A paper feeding apparatus according to claim 3, wherein said device information concerning said downstream device includes at least the number of trays thereof and tray information concerning said trays, wherein said converted information to be transmitted to said upstream device includes at least the number of trays resulting from addition of the number of trays of the apparatus itself to said number of trays, and tray information concerning the trays of said downstream device and the apparatus itself.

6. A paper feeding apparatus according to claim 5, wherein said tray information includes at least one of information about a loadable sheet size, information about a conveyance path, a capacity of loadable sheets, a current sheet load situation, and a type of sheets loaded at present.

7. A paper feeding apparatus according to claim 5, wherein said tray information includes conveyance path information and said conveyance path information includes information to identify a continuous conveyance path or an independent conveyance path.

8. A paper feeding apparatus according to claim 5, wherein said tray information includes a sheet delay jam detecting time, wherein when the apparatus itself has a sheet conveyance path continuous to said downstream device, said first control means transmits to said upstream device a value resulting from addition of said sheet delay jam detecting time of the apparatus itself to said sheet delay jam detecting time transmitted from said downstream device and wherein when the apparatus itself has no sheet conveyance path continuous to said downstream device, said first control means transmits to said upstream device said sheet delay jam detecting time transmitted from said downstream device.

9. A paper feeding apparatus according to claim 3, wherein said control information from said upstream device includes tray position information of a tray as a controlled object, wherein when said tray position information is judged as tray position information of said downstream device, said second control means converts said tray position information into tray position information resulting from subtraction of the number of trays of the apparatus itself from said tray position information and transmits the resultant tray position information to said downstream device.

10. A paper feeding apparatus according to claim 1, wherein said external device is a recording device for recording an image on a sheet.

11. A paper discharging apparatus used in electrical cascade connection of plural paper discharging devices with an external device, and comprising first communication means for communication between an electrically downstream paper discharging device and the apparatus itself and second communication means for communication between an electrically upstream paper discharging device and the apparatus itself, said apparatus comprising:

a means for acquiring device information concerning said downstream device through said first communication means;

a first control means for controlling the upstream device by converting said acquired device information concerning downstream device and device information of the apparatus itself together into device information as a single device, and transmitting to said upstream device by means of said second communication means; and a means for analyzing control information from said upstream device and transmitting control information through the apparatus itself to said downstream device, which is second control means for controlling the apparatus itself, based on information concerning the apparatus itself out of said control information, and transmitting information concerning said downstream device through said first communication means to said downstream device according to said control information.

12. A paper discharging apparatus according to claim 11, wherein said second control means comprises a separating means for separating said information concerning said downstream device from said control information.

13. A paper discharging apparatus according to claim 11, comprising a means for automatically effecting electrical connection with the upstream device and downstream device when physically connected to said upstream device and downstream device, wherein a sheet conveyance path from said upstream device to said downstream device is uniquely determined by said physical connection.

14. A paper discharging apparatus according to claim 11, comprising a means for effecting physical connection with said upstream device and downstream device and a means for effecting electrical connection with said upstream device and downstream device independently of each other, wherein each paper discharging device comprises an independent sheet conveyance path to said external device.

15. A paper discharging apparatus according to claim 13, wherein said device information concerning said downstream device includes at least the number of trays thereof and tray information concerning said trays, wherein said converted information to be transmitted to said upstream device includes at least the number of trays resulting from addition of the number of trays of the apparatus itself to said number of trays, and tray information concerning the trays of said downstream device and the apparatus itself.

16. A paper discharging apparatus according to claim 15, wherein said tray information includes conveyance path information and said conveyance path information includes information to identify a continuous conveyance path or an independent conveyance path.

17. A paper discharging apparatus according to claim 15, wherein said tray information includes at least one of conveyance path information, a capacity of loadable sheets, and a current sheet load situation.

18. A paper discharging apparatus according to claim 15, wherein said tray information includes a discharge completion time of a sheet, wherein when the apparatus itself has a sheet conveyance path continuous to said downstream device, said first control means transmits to said upstream device a value resulting from addition of a discharge completion time of the apparatus itself to said discharge completion time transmitted from said downstream device, and wherein when said apparatus itself has no sheet conveyance path continuous to said downstream device, said first control means transmits to said upstream device said discharge completion time transmitted from said downstream device.

19. A paper discharging apparatus according to claim 13, wherein said control information from said upstream device includes tray position information of a tray as a controlled object, wherein when said tray position information is judged as tray position information of said downstream device, said second control means converts said tray position information into tray position information resulting from subtraction of the number of trays of the apparatus itself from said tray position information and transmits the resultant tray position information to said downstream device.

20. A paper discharging apparatus according to claim 13, wherein said device information transmitted from said downstream device includes function information of said downstream device.

21. A paper discharging apparatus according to claim 20, wherein said function information includes information about at least some of normal stacking, job offset, staple, punch, folding, saddle stitch, and gluing.

22. A paper discharging apparatus according to claim 13, wherein the control information transmitted from said upstream device includes function designating information of a tray as a controlled object.

23. A paper discharging apparatus according to claim 11, wherein said external device is a recording device for recording an image on a sheet.

24. A sheet handling apparatus which can be connected to first and second external sheet handling devices, which comprises:

an accepting means for accepting a sheet from said first external sheet handling device;

a first communication means for communication with said first external sheet handling device;

a sending means for sending a sheet to said second external sheet handling device;

a second communication means for communication with said second external sheet handling device; and a first control means for acquiring information transmitted from one of said first and second external sheet handling devices through either one of said first and second communication means, for converting the acquired information according to said sheet handling device concerned, and for transmitting the converted information and information about said sheet handling device concerned, to the other of the first and second external sheet handling devices through the other of said first and second communication means.

25. A sheet handling apparatus according to claim 24, said sheet handling apparatus being a paper feeding device having a paper feed tray or a paper discharging device having a paper discharge tray.

26. A sheet handling apparatus according to claim 24, comprising second control means for, based on instruction information outputted through said other communication means from said other external sheet handling device, performing driving of said sheet handling device concerned or transmission of the instruction information to said one external sheet handling device through said one communication means.

27. A sheet handling apparatus according to claim 26, further comprising a means for judging a jam of a sheet, based on said acquired information, when the instruction information to said one external sheet handling device is transmitted through said one communication means.

* * * * *

UNITED STATES PATENT AND TRADEMARK OFFICE

CERTIFICATE OF CORRECTION

PATENT NO. : 6,487,379 B2
DATED : November 26, 2002
INVENTOR(S) : Kaoru Sato

It is certified that error appears in the above-identified patent and that said Letters Patent is hereby corrected as shown below:

Column 6,
Line 53, “time as it,” should read -- time, --.

Column 12,
Line 45, “time as it,” should read -- time, --.

Column 13,
Line 31, “b” should read -- be --.
Line 32, “e” should be deleted.

Signed and Sealed this

Tenth Day of June, 2003

JAMES E. ROGAN
*Director of the United States Patent and Trademark Office*